US006293623B1

(12) United States Patent
Kain et al.

(10) Patent No.: US 6,293,623 B1
(45) Date of Patent: Sep. 25, 2001

(54) JUVENILE SEAT ASSEMBLY

(75) Inventors: James M. Kain, Tipp City, OH (US); Timothy D. Holtke, New Whiteland, IN (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 09/160,562

(22) Filed: Sep. 25, 1998

Related U.S. Application Data

(60) Provisional application No. 60/060,067, filed on Sep. 26, 1997.

(51) Int. Cl.[7] ..... A47C 7/50

(52) U.S. Cl. ..... 297/423.25; 297/423.17; 297/153; 297/130

(58) Field of Search ..... 297/440.24, 411.43, 297/148, 149, 151, 153, 423.17, 423.25, 423.1, 440.1, 130

(56) References Cited

U.S. PATENT DOCUMENTS

| | | | | |
|---|---|---|---|---|
| D. 365,936 | | 1/1996 | Haut et al. . | |
| 1,021,901 | * | 4/1912 | Snideman et al. | 297/153 |
| 1,256,936 | * | 2/1918 | Shaver | 297/149 X |
| 1,295,043 | * | 2/1919 | Lattig | 297/440.1 |
| 2,168,513 | * | 8/1939 | Cobb | 297/148 |
| 2,633,899 | * | 4/1953 | Armstrong | 297/151 |
| 2,702,072 | | 2/1955 | Shuessler . | |
| 2,851,086 | * | 9/1958 | Weiner | 297/149 X |
| 3,012,815 | * | 12/1961 | Smith | 297/153 X |
| 4,008,918 | * | 2/1977 | Cooper et al. | 297/148 X |
| 4,105,247 | | 8/1978 | Saint . | |
| 4,534,072 | | 8/1985 | Lipski . | |
| 4,568,120 | | 2/1986 | Hoffman . | |
| 4,603,902 | | 8/1986 | Maloney . | |
| 4,714,292 | * | 12/1987 | Kassai | 297/423.1 X |
| 4,938,603 | | 7/1990 | Turner et al. . | |
| 5,165,755 | | 11/1992 | Rho . | |
| 5,183,311 | | 2/1993 | Meeker et al. . | |
| 5,238,292 | | 8/1993 | Golenz et al. . | |
| 5,483,901 | | 1/1996 | Tisbo et al. . | |
| 5,509,719 | | 4/1996 | Cone, II . | |
| 5,707,104 | * | 1/1998 | Perego | 297/463.1 X |
| 5,810,432 | | 9/1998 | Haut et al. . | |
| 5,829,830 | * | 11/1998 | Maloney | 297/153 X |
| 5,951,102 | * | 9/1999 | Poulson et al. | 297/130 X |

FOREIGN PATENT DOCUMENTS

| | | | | |
|---|---|---|---|---|
| 92276 | * | 5/1938 | (SE) | 297/153 |

OTHER PUBLICATIONS

385 Gerry™ Adjust–a–Height® Chair, 1994 Catalog, two pages.
Kolcraft® Perfect Height™, two pages, 1993.
The Versstile, Adjustable High Chair, Infantino Product Catalogue, three pages, 1994.
Playskool® 1–2–3 High Chair™, BabyCare Products 1994, three pages.
RIGHT HEIGHT™ (270195) and CELEBRITY™ (271181) Evenflo product advertisement, one page, prior art.
Aprica® Bed and Breakfast Two–in–one infant seat/cradle and high chair, two pages, prior art.
Cosco® Option 5™ High Chair, four pages, 1998, prior art.

* cited by examiner

*Primary Examiner*—Anthony D. Barfield
(74) *Attorney, Agent, or Firm*—Barnes & Thornburg

(57) ABSTRACT

A juvenile seat assembly includes a seat and a frame including front and rear legs coupled to the seat. The seat includes a seat bottom and a footrest mounted to the seat bottom. The footrest is formed to include a front-leg support coupled to each one of the front legs to block side-to-side movement of the seat relative to the frame.

23 Claims, 9 Drawing Sheets

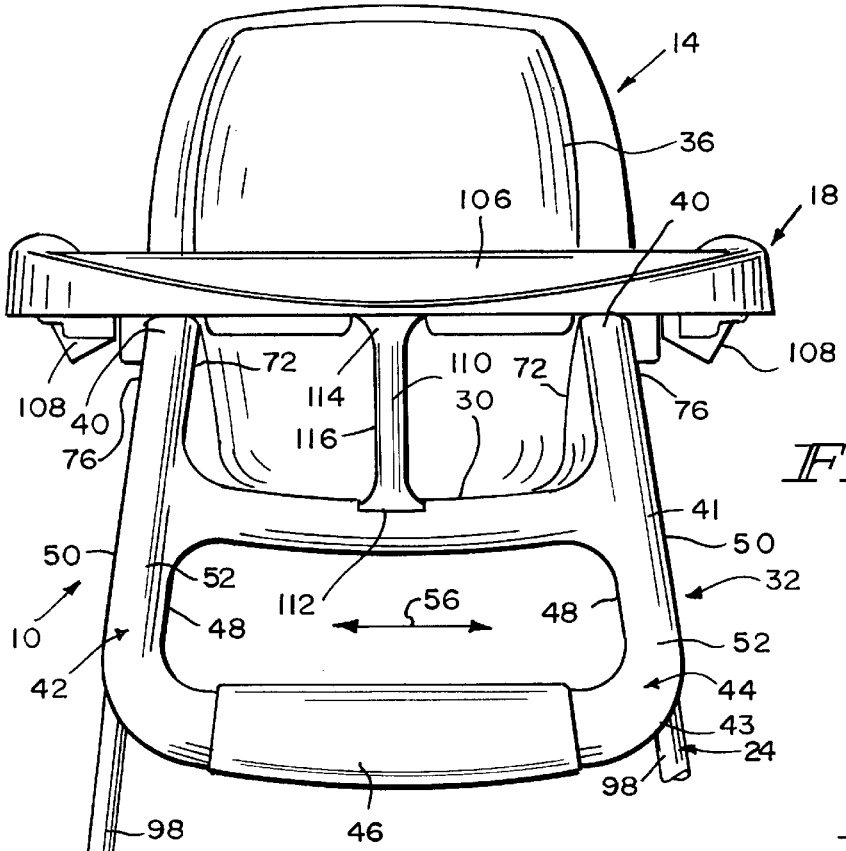
FIG. 4
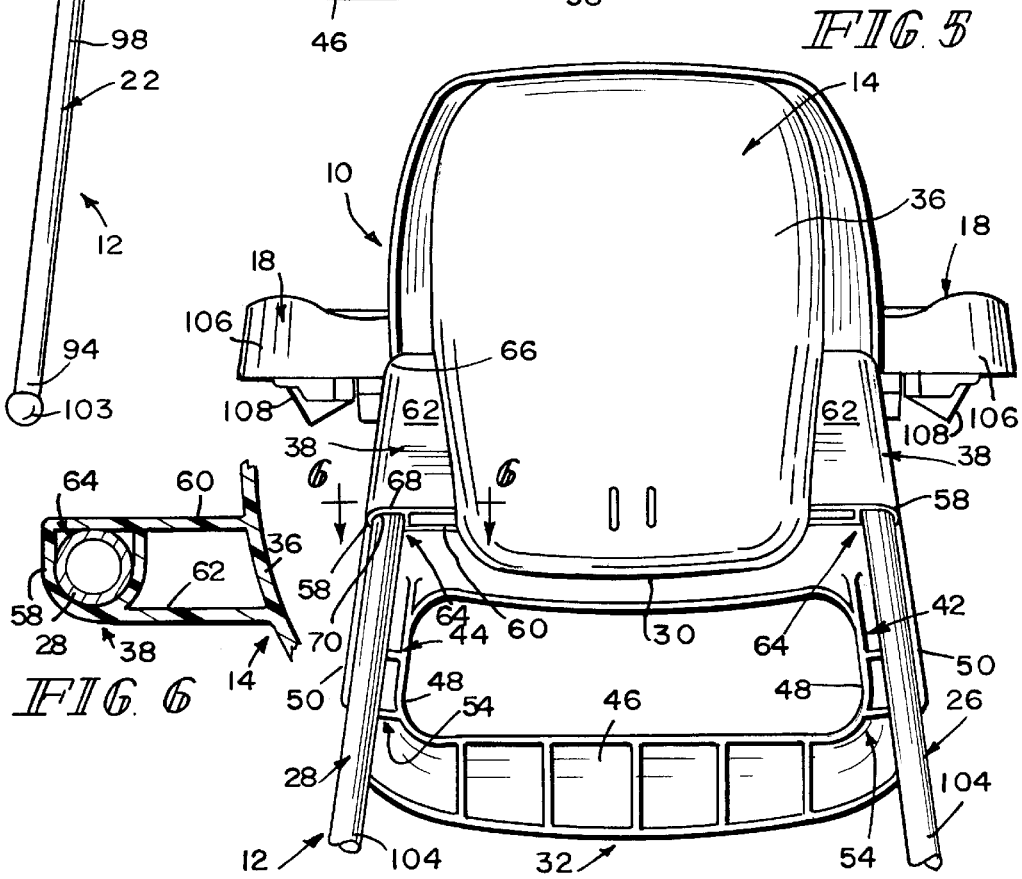
FIG. 5
FIG. 6

JUVENILE SEAT ASSEMBLY

This claims priority under 35 U.S.C. §119(e) of Ser. No. 60/060,067 filed Sep. 26, 1997.

BACKGROUND AND SUMMARY OF THE INVENTION

This invention relates to a juvenile seat, and particularly to a juvenile seat assembly having a chair that is mounted on a pair of front legs and a pair of back legs. More particularly, the present invention relates to a juvenile seat assembly having a plastic seat mounted on front and back legs.

Juvenile high chairs are widely accepted as necessary appliances for seating young children comfortably during a meal or other activity. See, for example, U.S. Pat. No. Des. 365,936 to Haut et al.

According to the present invention, a juvenile seat assembly includes a frame, a plastic seat coupled to the frame, and a tray coupled to the seat. The frame includes front legs and back legs coupled to the seat to situate the seat in a predetermined position above a floor. The seat includes a footrest coupled to the front legs to block side-to-side movement of the seat on the front legs, while permitting front legs to be moved in a generally downward direction to remove front legs from the seat during transport of the juvenile seat assembly from one location to another, or to permit the seat to be used as a booster seat with or without the tray.

In preferred embodiments, the seat includes a seat bottom coupled to the footrest, a seat back extending upwardly from the seat bottom, rear-leg mounts coupled to the seat back, and elevated arms extending between the seat bottom and the seat back and defining front-leg mounts therein. In addition, the footrest includes opposite limbs extending from the seat bottom and a leg support extending between the limbs. The limbs include passageways that are in general alignment with the front-leg mounts and guides that extend into the passageways and define a channel. Each front-leg mount cooperates with one of the guides to couple the respective front leg to the seat. The rear-leg mounts couple the back legs to the seat.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 4 is a front view the juvenile seat assembly of FIG. 1, with a portion of one front leg cut away, showing the relative positioning of front legs and the limbs of the footrest;

FIG. 5 is a rear view of the juvenile seat assembly of FIG. 4, showing the back legs spaced-apart from one another and extending into the rear-leg mounts of the seat;

FIG. 6 is a view taken along lines 6—6 of FIG. 5 showing the rear-leg mount including a rear-leg sleeve coupled to the seat back by spaced-apart struts and the back leg extending through the rear aperture of the rear-leg sleeve to couple the back leg to the seat;

DETAILED DESCRIPTION OF THE DRAWINGS

Figure 1:
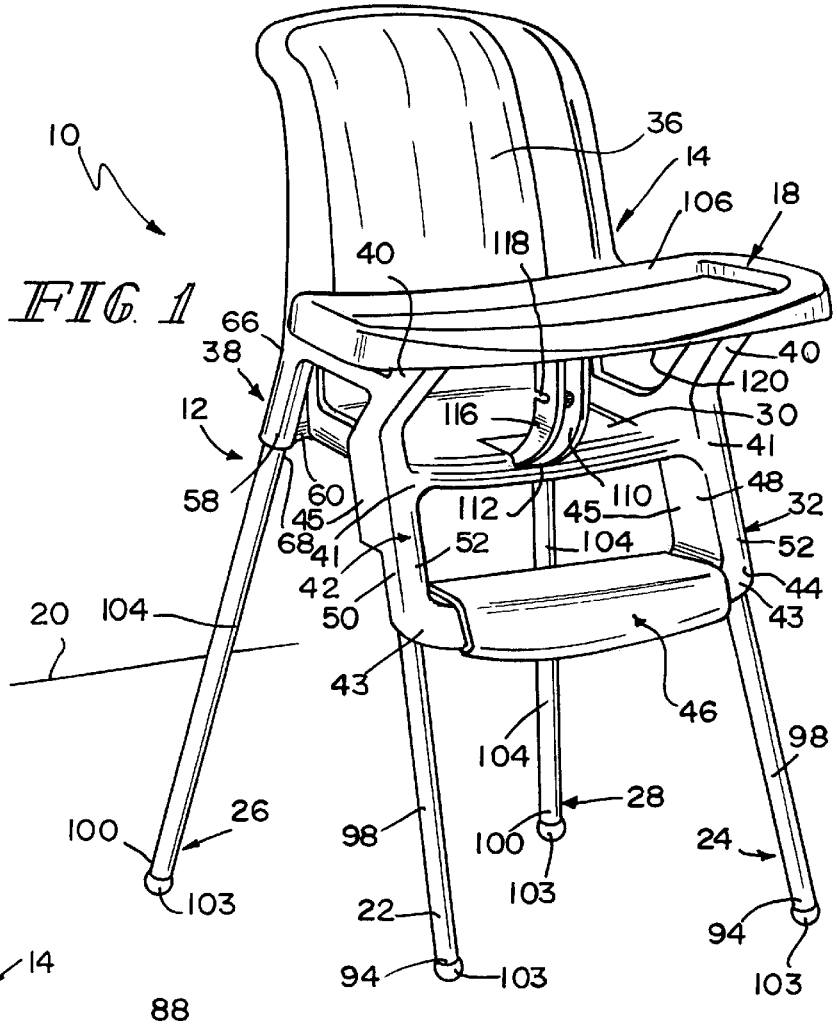
FIG. 1 is a perspective view of a juvenile seat assembly including a seat, a frame coupled to the seat, and a tray, showing the seat having a seat bottom, a seat back extending upwardly from the seat bottom, a rear-leg mount coupled to the seat back, elevated arms extending between the seat bottom and the seat back, and a footrest coupled to seat bottom, the frame including a pair of front legs and a pair of back legs coupled to the front-leg and rear-leg mounts, and the footrest including opposite limbs and a support extending between the opposite limbs.
Figure 2:
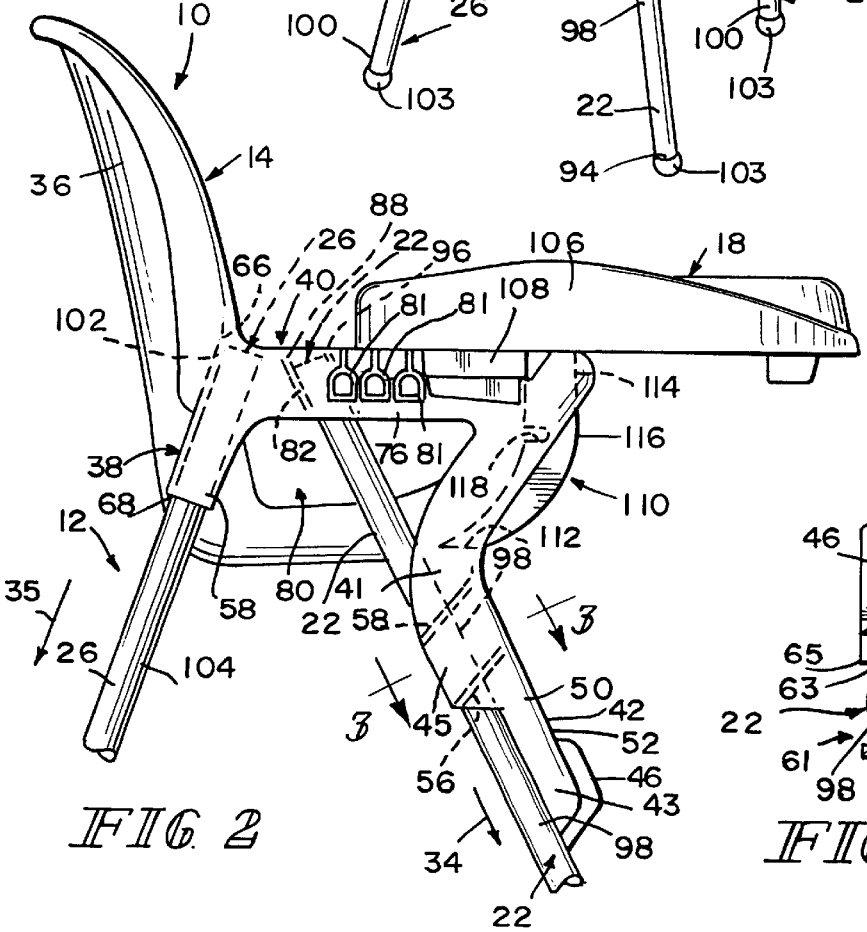
FIG. 2 is a side view of juvenile seat assembly of FIG. 1 showing one rear-leg mount of the seat positioned to lie adjacent to the back portion and defining a rear passageway that receives the back leg therein and a front-leg mount formed in the arm adjacent to the rear-leg mount, the front-leg mount defining a front passageway that receives the front leg therein.

A juvenile seat assembly 10 is shown in FIG. 1. Seat assembly 10 includes a frame 12, a seat 14 coupled to frame 12, and a tray assembly 18 coupled to seat 14. Frame 12 includes front legs 22, 24 and back legs 26, 28 coupled to seat 14 to situate seat 14 in a predetermined position above a surface such as a floor 20. Engagement between front legs 22, 24 and back legs 26, 28, and seat 14 allow the user to couple seat 14 on frame 12 easily. Seat 14 includes a seat bottom 30 and a footrest 32 extending from seat bottom 30, which engages front legs 22, 24 to block side-to-side movement of seat 14 on front legs 22, 24. Footrest 32, as shown in FIG. 2, permits front legs 22, 24 to be moved in a generally downward direction, as shown by arrow 34, to remove front legs 22, 24 from seat 14 during transport of juvenile seat assembly 10 from one location to another.

Seat 14 further includes a seat back 36 extending upwardly from seat bottom 30, rear-leg mounts 38 coupled to seat back 36, and elevated arms 40 extending between seat bottom 30 and seat back 36 for supporting tray assembly 18. As shown in FIG. 1, footrest 32 includes opposite limbs 42, 44 extending from seat bottom 30 and a foot support 46 extending between opposite limbs 42, 44. Although only limb 42 and front leg 22 will be discussed hereafter, this disclosure applies to limb 44 and front leg 24.

Figure 3:
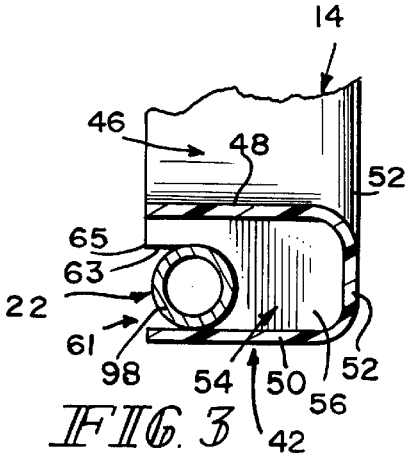
FIG. 3 is a cross-sectional view taken along lines 3—3 of FIG. 2 showing the footrest including a passageway and a guide extending into the passageway and defining a cavity that receives the front leg therethrough to block side-to-side movement of the seat relative to the front legs.

As shown in FIG. 1, limb 42 includes an upper end 41 adjacent to seat bottom 30, a lower end 43 adjacent to support 46, and a middle portion 45 positioned between upper and lower ends 41, 43. As shown in FIGS. 3 and 5, passageway 54 extends between middle portion 45 and upper end 41. As shown in FIG. 3, limb 42 includes an inner panel 48, an opposite outer panel 50, and a front panel 52 extending between inner and outer panels 48, 50. As shown in FIG. 3, panels 48, 50, 52 cooperate to define a passageway 54 sized to receive front leg 22 therethrough. In addition, limb 42 includes spaced-apart guides 56, 58 extending into passageway 54 and each guide 56, 58 defines an aperture 61 sized to receive front leg 22 therethrough. Apertures 61 are defined by a generally-U-shaped rim 63 that engages front leg 22. In addition, rim 63 defines an opening 65 into aperture 61 as shown, for example, in FIG. 3. Since front leg 22 extends through passageway 54 and apertures 61 of footrest 32, front legs 22 are coupled to seat 14 in a manner that blocks side-to-side movement of seat 14 on frame 12, shown by arrow 56 in FIG. 4.

Figure 7:
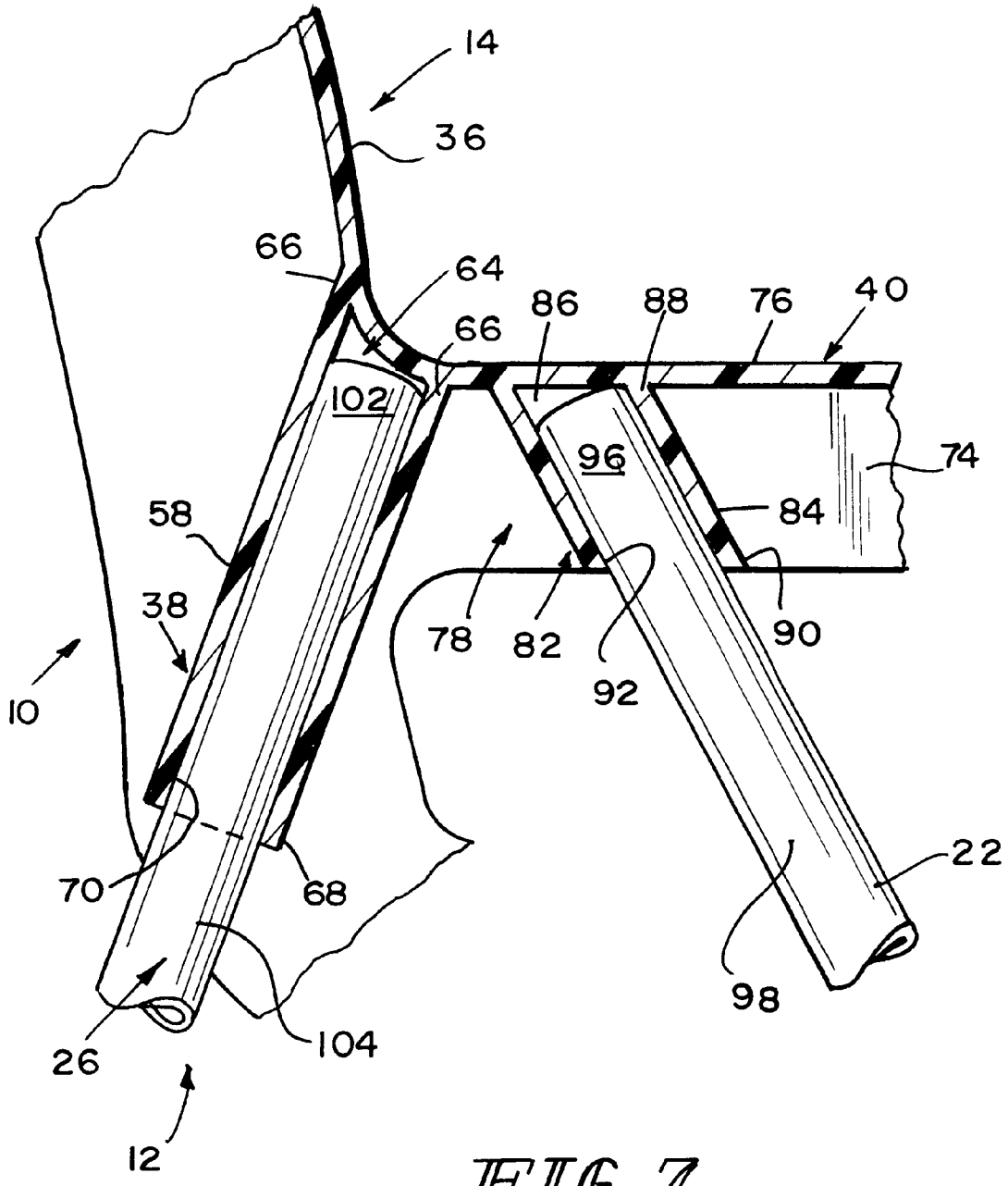
FIG. 7 is an enlarged cross-sectional side view of the juvenile seat assembly of FIG. 1 slowing the arm including an outer surface and a lip extending from the outer surface, the front-leg mount including a side wall coupled to the outer surface and lip of the arm and defining the front passageway and showing front and back legs extending into the front and rear apertures respectively.

Referring now to FIG. 5, rear-leg mounts 38 are coupled to seat 14 to lie adjacent to back portion 36 and extend away from arms 40. While only one rear-leg mount 38 and leg 28 will be discussed hereafter, the disclosure applies to both rear-leg mounts 38 and to leg 26. As shown in FIG. 6, rear leg mount 38 includes an a rear-leg sleeve 58 coupled to back portion 36 by spaced-apart struts 60, 62. Rear-leg sleeve 58 defines a rear passageway 64 sized to receive back leg 28 therein. In addition, as shown in FIG. 7, rear-leg sleeve 58 includes an inner end 66 adjacent to arm 40, an outer end 68 defining an opening 70 into rear passageway 64, and rear passageway 64 extends between inner end 66 and outer end 68.

As shown in FIGS. 2 and 4, arms 40 extend between seat bottom 30 and seat back 36 for supporting tray assembly 18. Although only one arm 40 will be described hereafter, the disclosure applies to both arms. Arm 40 includes an inner surface 72. In addition, as best shown in FIG. 7, arm 40 includes an outer surface 74 and a lip 76 extending over outer surface 74 to define a recess 78. Referring again to FIG. 2, arm 40 cooperates with seat bottom 30 to define an aperture 80 therebetween and lip 76 is formed include slots 81 sized to receive and lock latch tray assembly 18 to seat 14, as will be described hereafter.

Seat 14 further includes a front-leg mount 82 coupled to each arm 40 in recess 78. While only one front-leg mount 82 will be discussed hereafter, the disclosure applies to both front-leg mounts. As shown in FIGS. 2 and 7, front-leg mount 82 includes a front-leg sleeve 84 coupled to outer surface 74 and lip 76. Front-leg sleeve 84 defines a passageway 86 that is sized to receive front leg 22 therein. Front-leg sleeve 84 further includes an upper end 88 and an opposite lower end 90 defining an opening 92 into passageway 86.

Referring now to FIGS. 1 and 2, front legs 22, 24 are coupled to seat 14 and are positioned to lie in a spaced-apart generally parallel relationship relative to one another. Front legs 22, 24 each include a bottom end 94 positioned to lie adjacent to floor 20 and an opposite top end 96 mounted in front-leg mount 82, and a center portion 98 extending between top and bottom ends 96, 94. As shown in FIGS. 2 and 3, center portion 98 extends through passageway 54 of footrest 32 to stabilize seat 14 on front legs 22, 24.

Back legs 26, 28 are also coupled to seat 14 and lie in a spaced-apart generally parallel relationship relative to one another. Back legs 26, 28 angle away from front legs 22, 24 so that frame 12 is shaped as a generally inverted letter V. Back legs 26, 28 include a bottom end 100 positioned to lie adjacent to floor 20 and an opposite top end 102 mounted in rear-leg mount 38, and a center portion 104 extending between top and bottom ends 102, 100. Plastic feet 103 are coupled to bottom ends 94, 100 of front and back legs 22, 24 and 26, 28.

Tray assembly 18 includes a tray 106, two latches 108 that couple tray 106 to seat 14, and a crotch post 110 extending between tray 106 and seat bottom 30. Latches 108 enable the caregiver to use either one or both of their hands to mount and remove tray 106 from seat 14. Tray assembly 18 is coupled to seat 14 of seat assembly 10 so that tray 106 extends across arms 40 of seat 14 as shown in FIGS. 1, 2, and 4. Latches 108 are configured to release tray 106 from seat 14 to enable caregiver to slide tray 106 on arms 40 between a fully-retracted position and a fully-expanded position. Latches 108 also enable the caregiver to remove tray 106 from seat 14. A further description of tray assembly may be found in U.S. patent application Ser. No. 09/092,217, entitled "Release Mechanism for Tray", filed Jun. 5, 1998, the specification of which is incorporated herein by reference.

Crotch post 110 of tray assembly 18 includes a foot portion 112, a hip portion 114, and a leg portion 116 interconnecting foot portion 112 and hip portion 114. As shown in FIG. 1, leg portion 116 includes a notch 118 therein that is formed to receive a portion of inward edge 120 of tray 106 therein when crotch post 10 is in a retracted position. A further description of crotch post 110 may be found in U.S. patent application Ser. No. 09/092,126, entitled "Tray Assembly with Crotch Post", filed Jun. 5, 1998, the specification of which is incorporated herein by reference.

To assemble seat assembly 10, a user couples feet 103 to bottom ends 94, 100 of front and back legs 22, 24 and 26, 28. Back legs 26, 28 are then inserted through respective openings 70 of rear-leg mount 38 until top end 102 of back legs 26, 28 extends through rear passageway 64 and lies adjacent to inner end 66 of rear-leg mount 38. To couple front legs 22, 24 to seat 14, each front leg 22, 24 is first inserted through apertures 61 of guides 56, 58 and passageway 54 of footrest 32. Top ends 96 of front legs 22, 24 are inserted though opening 92 of front-leg mount 82 until top end 96 lies adjacent to upper end 88 of front-leg mount 82. At that time, seat 14 is mounted on frame 12.

To disassemble seat assembly 10, the user must only pull front legs 22, 24 out from front-leg mount 82 and passageway 54 of footrest 32 in direction 34 shown in FIG. 2. Rear legs 26, 28 then pulled out from rear-leg mount 38 in direction 35. Thus, seat assembly 10 can be assembled and disassembled in an easy fashion when it is necessary to transport seat assembly 10 from one location to another.

Figure 8:
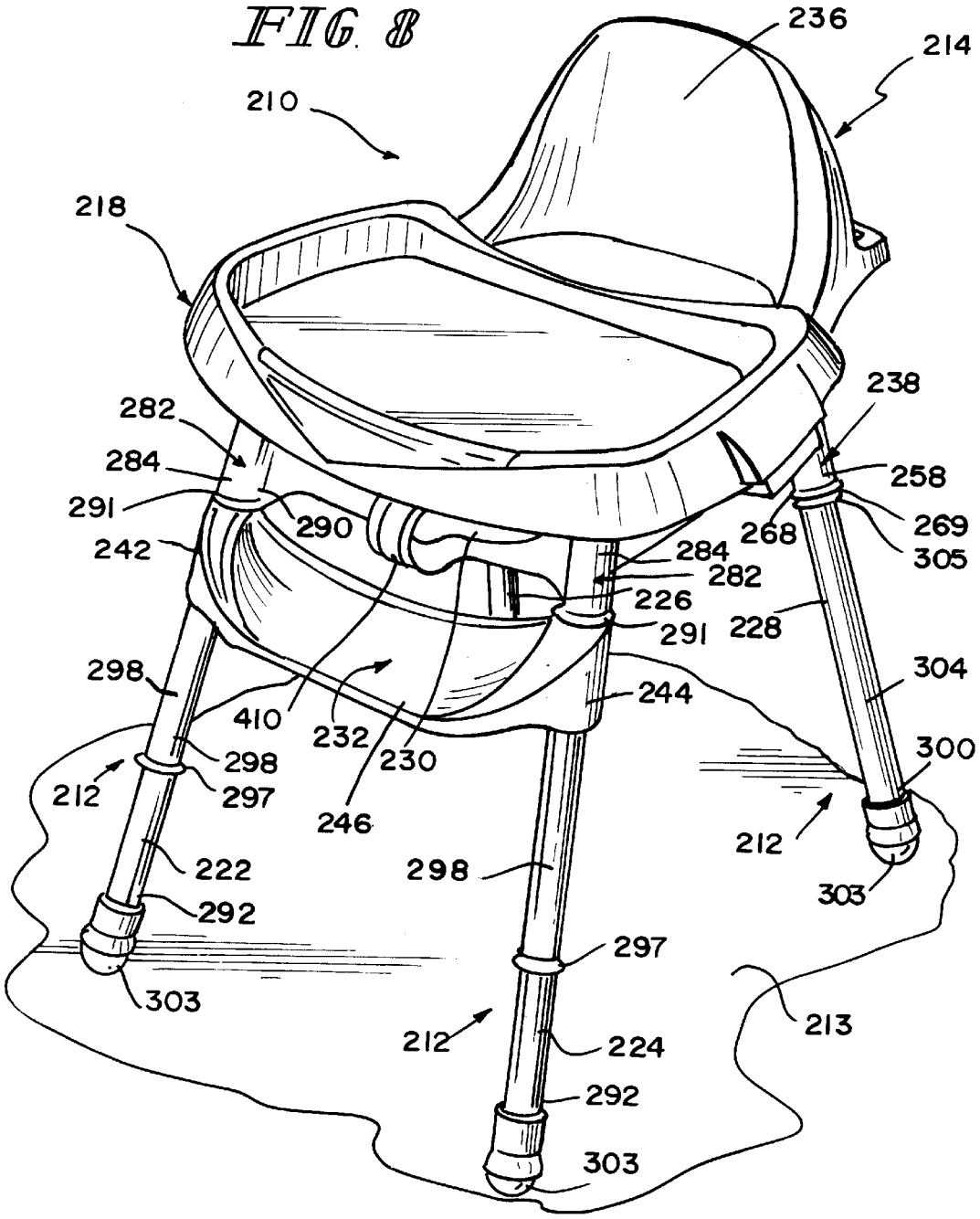
FIG. 8 is a perspective view of a juvenile seat assembly in accordance with another embodiment of the present invention, the assembly including a seat, a footrest, a frame coupled to the seat and footrest, and a tray coupled to the seat, showing the seat having a seat bottom, a seat back extending upwardly from the seat bottom, a rear-leg mount coupled to the seat back, elevated arms extending between the seat bottom and the seat back, and a crotch post coupled to the seat bottom, the frame including a pair of front legs extending into the footrest and a pair of back legs extending into the rear-leg mounts.
Figure 9:
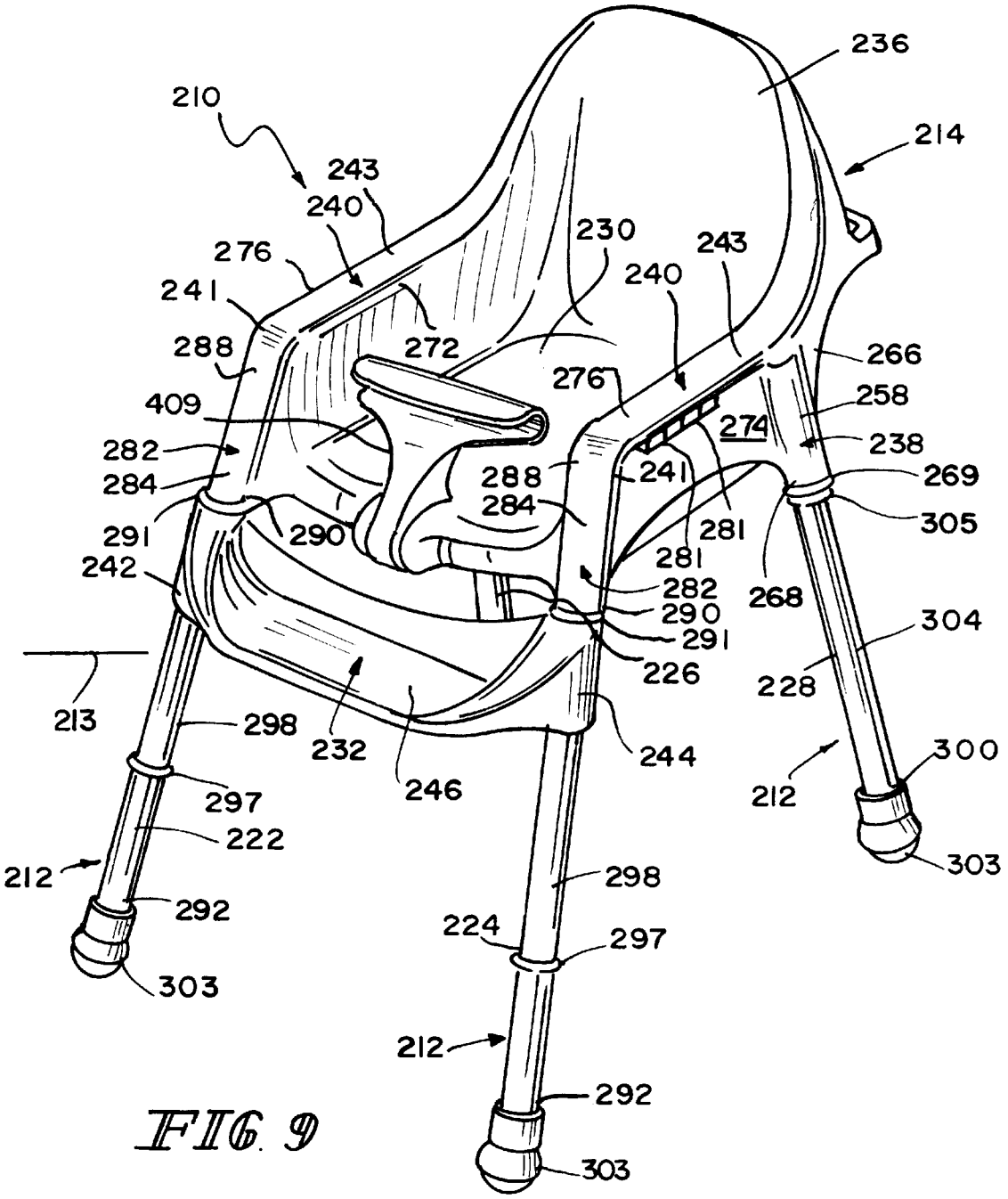
FIG. 9 is a perspective view of the juvenile seat assembly of FIG. 8 following removal of the tray from the seat, showing the seat including front-leg mounts positioned to lie adjacent to the opposite arms and the crotch post coupled to the seat bottom between the front-leg mounts, the crotch post extending away from the footrest.

A juvenile seat assembly 210 in accordance with the present invention is shown in FIGS. 8–13. Referring now to FIGS. 8 and 9, seat assembly 210 includes a frame 212, a seat 214 coupled to frame 212, a footrest 232, and a removable tray assembly 218 coupled to seat 214. Frame 212 includes front legs 222, 224 and back legs 226, 228 coupled to seat 214 to situate seat 214 on frame 212 at a predetermined height above a surface such as a floor 213. Front legs 222, 224 include spaced-apart flanges 297, 299 (see FIGS. 8 and 12) that are sized to engage footrest 232 during assembly of seat assembly 210. Flanges 297, 299 enable the user to adjust the height of seat 214 by turning front legs 222, 224 upside down and installing them into footrest 232 and front-leg mount 282

As shown in FIG. 9, seat 214 includes a seat bottom 230, a seat back 236 extending upwardly from seat bottom 230, rear-leg mounts 238 coupled to seat back 236, elevated arms 240 extending between seat bottom 230 and seat back 236 for supporting tray assembly 218, a crotch post 409 extending between seat bottom 230 and tray assembly 218, and front-leg mounts 282 extending from arms 240 spaced-apart from rear-leg mounts 238. Crotch post 409 of tray assembly 218 is formed for pivoting movement relative to seat bottom 230. As shown in FIG. 9, a footrest 232 is coupled to front legs 222, 224 adjacent to front-leg mounts 282 of seat 214.

Arms 240 extend between seat bottom 230 and seat back 236 for supporting tray assembly 218. Although only one arm 240 will be described hereafter, the disclosure applies to both arms. Referring now to FIG. 9, arm 240 includes a front end 241, an opposite back end 243 adjacent to seat back 236, an inner surface 272, an opposite outer surface 274, and a lip 276 extending over outer surface 274. As shown in FIG. 9, lip 276 is formed include slots 281 sized to receive and lock latch tray assembly 218 to seat 214, as will be described hereafter.

Figure 10:
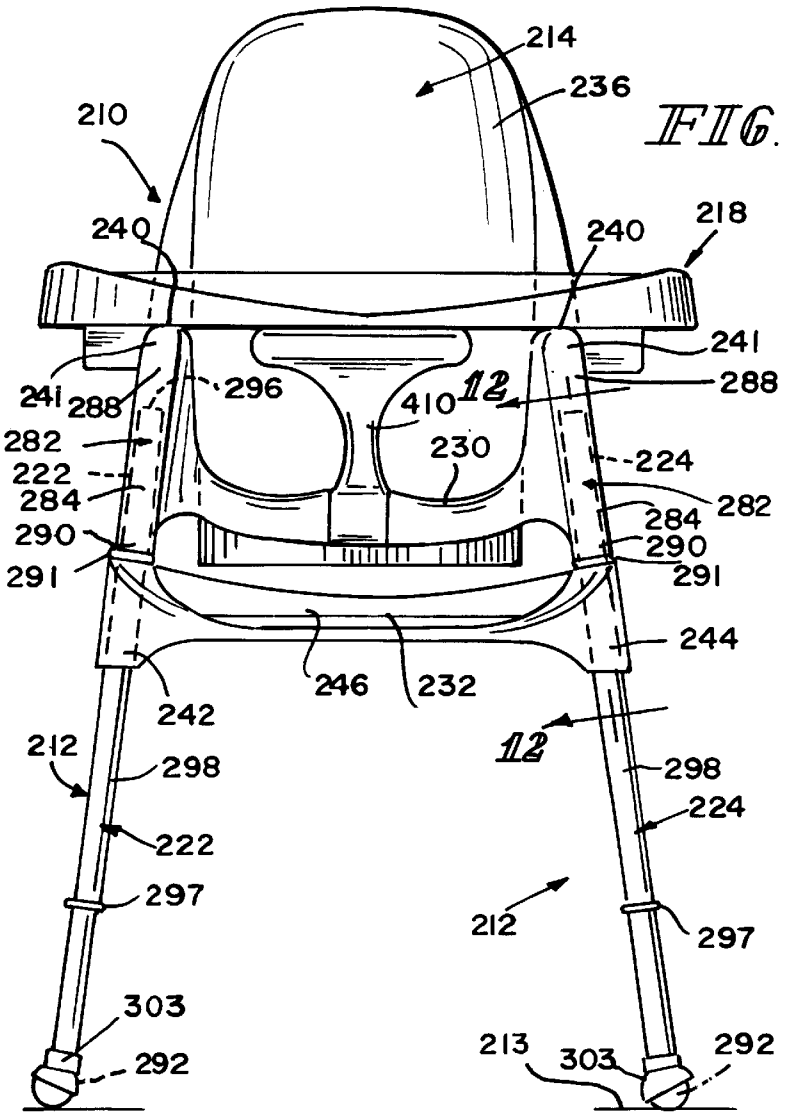
FIG. 10 is a front view of the juvenile seat assembly of FIG. 8, showing the footrest including opposite limbs in alignment with the opposite front-leg mounts and the front legs, in phantom, extending through the limbs of the footrest and into the front-leg mounts.
Figure 12:
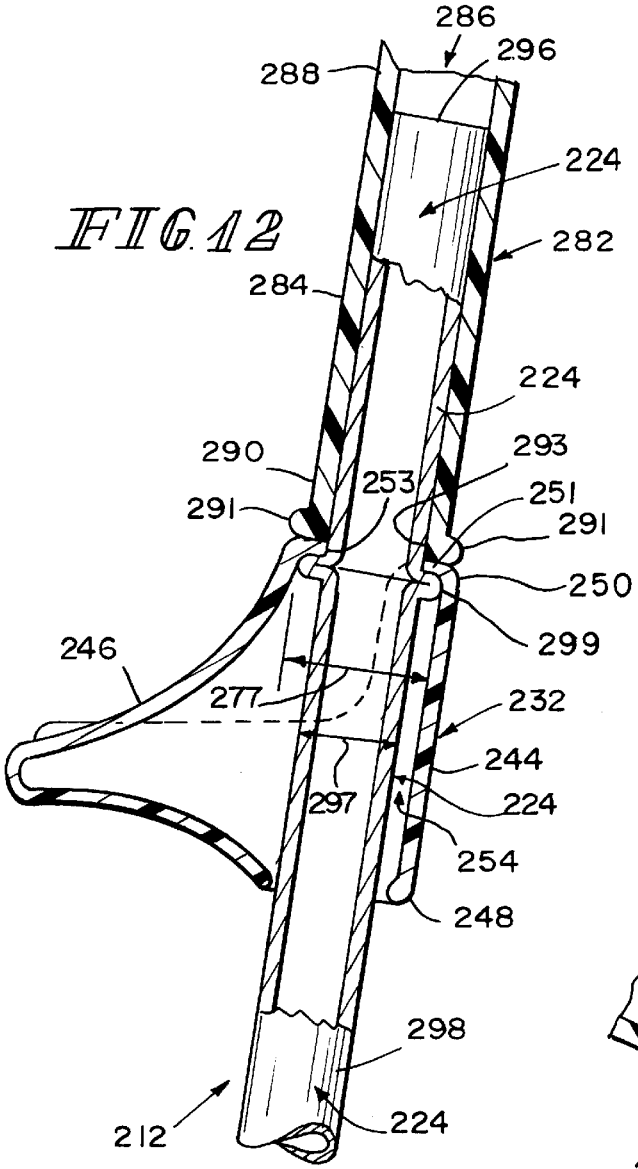
FIG. 12 is a view taken along lines 12—12 of FIG. 10 showing the front-leg mount including a lip defining an opening into a cavity, the front leg including a top end, a center portion extending from the top end, and a flange extending outwardly from the center portion, and the limb of the footrest includes an upper surface defining a passageway receiving the center portion of the leg therethrough, and upper surface of the footrest coupled between the flange and the lip.

Referring now to FIG. 10, front-leg mount 282 is coupled to front end 241 of each arm 40. While only one front-leg mount 282 will be discussed hereafter, the disclosure applies to both front-leg mounts. As best shown in FIG. 12, front-leg mount 282 includes a front-leg sleeve 284 that defines a front passageway 286 sized to receive front leg 224 therein. Front-leg sleeve 284 further includes an upper end 288 and an opposite lower end 290 defining an opening 292 into front passageway 286. In addition, lower end 290 includes a lip 291 extending radially outwardly therefrom.

Figure 11:
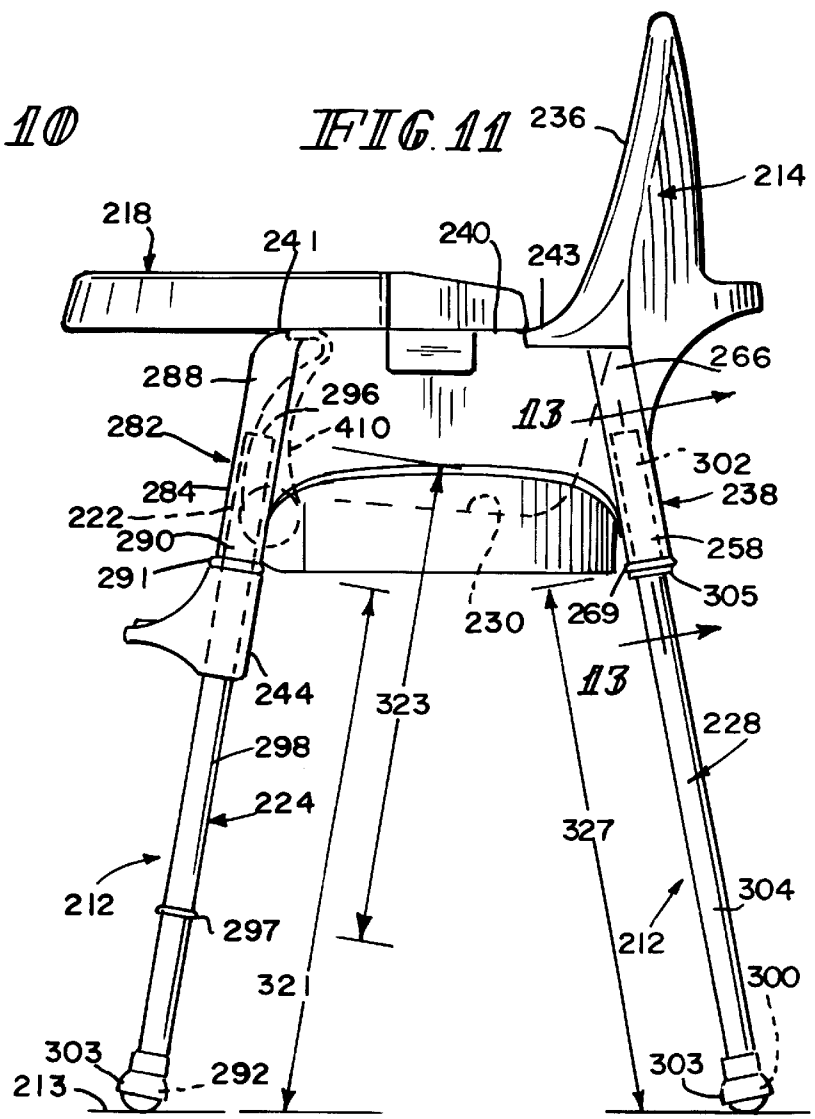
FIG. 11 is a side view of the juvenile seat assembly of FIG. 10 showing the back leg including a center portion and a flange extending from the center portion and the back leg extending into the rear-leg mount, in phantom, so that the flange engages a lip of the rear-leg mount.
Figure 13:
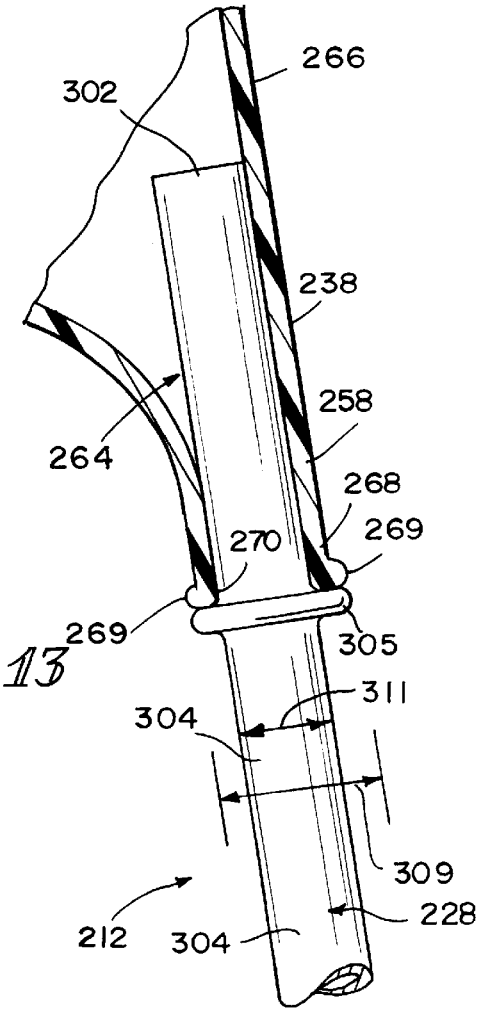
FIG. 13 is view taken along lines 13—13 of FIG. 11 showing the lip of the rear-leg mount defining an opening into a rear passageway and the flange of the rear leg engaging the lip of the rear-leg mount to couple the rear leg to the seat.

Referring now to FIG. 11, rear-leg mounts 238 are coupled to seat 214 adjacent to back end 243 of arms 240 and extend away from back portion 236. While only one rear-leg mount 238 and leg 228 will be discussed hereafter, the disclosure applies to both rear-leg mounts 238 and to leg 226. As shown in FIG. 13, rear leg mount 238 includes an a rear-leg sleeve 258 extending from back portion 236. Rear-leg sleeve 228 defines a rear passageway 264 sized to receive back leg 228 therein. In addition, as shown in FIG. 13, rear-leg, sleeve 258 includes an inner end 266 adjacent to arm 240, an outer end 268, and rear passageway 264 extends between inner end 266 and outer end 268. Outer end 268 includes a radially outwardly extending lip 269 and defines an opening 270 into rear passageway 264.

Footrest 232 includes opposite limbs 242, 244 extending toward front-leg mounts 282 and a foot support 246 extending between opposite limbs 242, 244. Although only limb 244 and front leg 224 will be discussed hereafter, it is understood that the disclosure applies to limb 242 and front leg 222. As shown in FIG. 12, Limb 244 includes a lower end 248, an upper end 250, and a passageway 254 extending between upper and lower ends 250, 248. Upper end 250 includes an upper lip 251 defining an opening 253 into passageway 254. Upper lip 251 is configured to lie adjacent to lip 291 of-front-leg mount 282 so that passageway 248 of footrest 232 is in general alignment with front passageway 286 of front-leg mount 282.

Referring now to FIG. 10, front legs 222, 224 include a bottom end 292 positioned to lie adjacent to floor 213 and an opposite top end 296 mounted in front-leg mount 282, and a center portion 298 extending between top and bottom ends 296, 292. As shown in FIG. 12, center portion 298 extends through passageway 254 of footrest 232 Flange 299 is coupled to center portion 298 and has a first dimension 277 that is greater than the second dimension 279 of opening 253 and is therefore coupled within passageway 254 of footrest 232. Flange 299 prevents footrest 232 from sliding on center portion 298 toward bottom end 292. In addition, as shown in FIG. 10, center portion 298 includes a second flange 297 spaced-apart from flange 299. Second flange 297 has a dimension similar to first dimension 277 of flange 299. As shown in FIG. 11, flange 299 lies a predetermined distance 321 from bottom end 292 and flange 297 lies a predetermined distance 323 from top end 296. Distance 321 is greater than distance 323. Therefore, second flange 297 enables the user to alter the height of seat 214 from floor 213 by turning legs 222, 224 upside down and installing them into footrest 232 and front-leg mount 282.

Referring now to FIG. 11, back legs 226, 228 also include a bottom end 300 positioned to lie adjacent to the floor and an opposite top end 302 mounted in rear 30 leg mount 238, and a center portion 304 extending between top and bottom ends 302, 300. As shown in FIG. 13, center portion 304 includes a flange 305. Flange 305 has a dimension 309 that is greater than the dimension 311 of opening 270 of rear-leg mount 238. Flange 305 limits the sliding movement of center portion 304 into passageway 264 and cooperates with front legs 222, 224 to establishes a pre-determined height of seat 14. Plastic feet 303 are coupled to bottom ends 292, 300 of front and back legs 222, 224 and 226, 28. Front legs 222, 224 extend generally parallel to one other and back legs 226, 228 extending generally parallel to one other.

Tray assembly 218 includes a tray 306 and two latches 308 that couple tray 306 to seat 214 Latches 308 enable the caregiver to use either one or both of their hands to mount and remove tray 306 from seat 214. A further description of tray assembly 306 be found in U.S. patent application Ser. No. 09/092,217, entitled "Release Mechanism for Tray", filed Jun. 5, 1998, the specification of which is incorporated herein by reference.

To assemble seat assembly 210, a user couples feet 303 to pre-selected bottom end 294 of front legs 222, 224 and bottom end 300 of back legs 226, 228, as shown in FIGS. 10 and 11. As shown in FIG. 12, top end 296 of each front leg 222, 224 is inserted through passageway of footrest 332 until flange 299 engages lip 251. Then, top end 296 of each front leg 222, 224 is inserted though opening 293 until upper ends 250 of limbs 242, 244 engage lip 291 of front-leg mount 282. At this time, top end 296 is mounted in front-leg mount 282 adjacent to upper end 288. Back legs 226, 228 are then inserted through respective openings 270 of rear-leg mount 238 until flange 305 engages lip 269, as shown in FIG. 13. Flange 305 is spaced-apart from bottom end 300 of back leg 228 a predetermined distance 327 which is equivalent to distance 321. At this time, top end 302 is mounted in rear-leg mount 238 adjacent to inner end 266.

To adjust the height of seat 214, the user must only remove plastic feet 303 from front legs 222, 224 and insert top ends 296 into feet 303. At this time, the user simply extends bottom ends 292 of front legs 222, 224 through passageway of footrest 332 until flange 297 engages lip 251. Then, bottom end 292 of each front leg 222, 224 is inserted though opening 293 until upper ends 250 of limbs 242, 244 engage lip 291 of front-leg mount 282. At this time, bottom end 292 is mounted in front-leg mount 282 adjacent to upper end 288 and seat 214 is positioned at a second pre-determined height.

Figure 14:
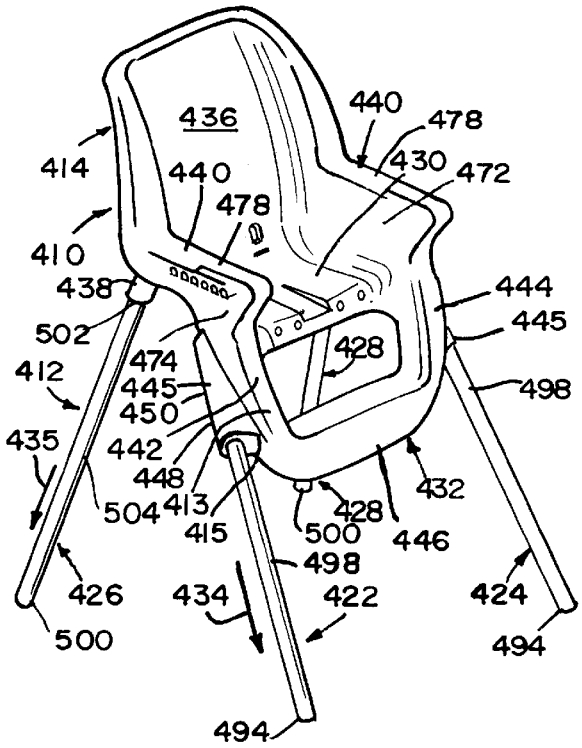
FIG. 14 is a perspective view of a juvenile seat assembly including a seat and a frame coupled to the seat, showing the seat having a seat bottom, a seat back extending upwardly from the seat bottom, a rear-leg mount coupled to the seat back, elevated arms extending between the seat bottom and the seat back, and a footrest coupled to seat bottom, the frame including a pair of front legs and a pair of back legs coupled to the front-leg and rear-leg mounts, and the footrest including opposite limbs, a support extending between the opposite limbs, and a front-leg cover coupled to the limb.

A juvenile seat assembly 410 is shown in FIG. 14. Seat assembly 410 includes a frame 412, and a seat 414 coupled to frame 412. Frame 412 includes front legs 422, 424 and back legs 426, 428 coupled to seat 414 to situate seat 414 in a predetermined position above a surface such as a floor. Engagement between front legs 422, 424 and back legs 426, 428, and seat 414 allow the user to couple seat 414 on frame 412 easily. Seat 414 includes a seat bottom 430 and a footrest 432 extending from seat bottom 430, which engages front legs 422, 424 to block side-to-side movement of seat 414 on front legs 422, 424. Footrest 432, as shown in FIG. 14, permits front legs 422, 424 to be moved in a generally downward direction, as shown by arrow 434, to remove front legs 422, 424 from seat 414 during transport of juvenile seat assembly 410 from one location to another.

Seat 414 further includes a seat back 436 extending upwardly from seat bottom 430, rear-leg mounts 438 coupled to seat back 436, elevated arms 440 extending between seat bottom 430 and seat back 436 for supporting tray assembly 218, and a front-leg mount 482 coupled to each arm 440. As shown in FIG. 14, footrest 432 includes opposite limbs 442, 444 extending from seat bottom 430 and a foot support 446 extending between opposite limbs 442, 444. Each limb 442 includes a vertical segment inter connecting seat bottom 430 and foot support 446 and including a front panel 413 and, a side panel 415, and a front-leg support 445 coupled to side panel 415 and positioned to lie in spaced-apart relation to a companion front-leg mount 482 as shown, for example, in FIG. 18.

Figure 15:
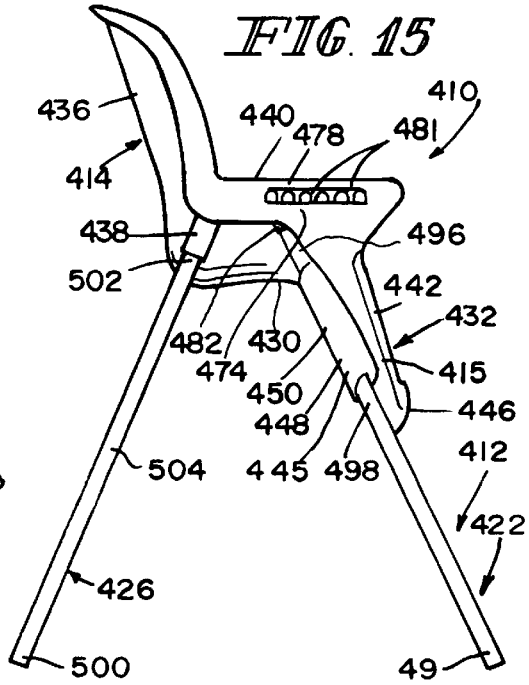
FIG. 15 is a side view of juvenile seat assembly of FIG. 14 showing one rear-leg mount of the seat positioned to lie adjacent to the back portion and receiving the back leg therein, a front-leg mount coupled to the arm adjacent to the rear-leg mount, and the front leg extending trough the front-leg cover.
Figure 18:
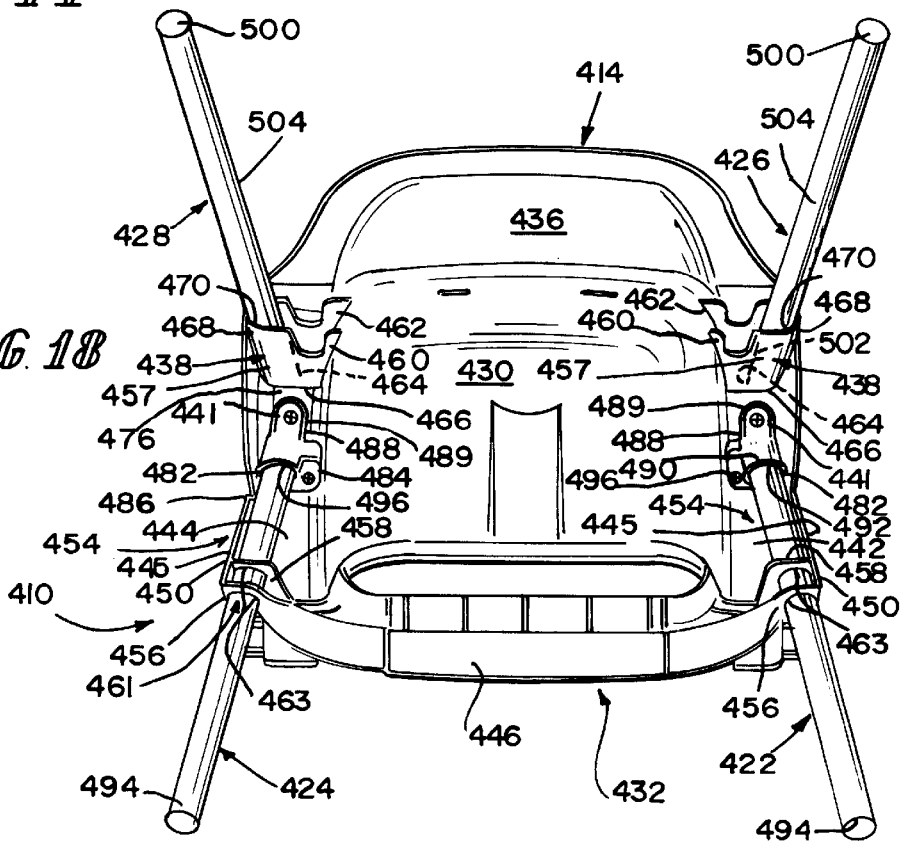
FIG. 18 is a bottom view of the juvenile seat assembly of FIG. 14, showing the front-leg mounts coupled to arm by a screw and the front-leg cover including a side panel and spaced-apart guides extending between the side panel and the limbs.

As shown in FIG. 18, each front-leg support 445 of limbs 442, 444 defines a passageway 454 through which front legs 422, 424 extend. As shown in FIGS. 14 and 15, front-leg support 445 includes a front panel 448 and a side panel 450 extending from front panel 448. Referring again to FIG. 18, panels 448, 450 cooperate to define passageway 454. Since front legs 422, 424 extend through passageways 454 of footrest 432, front legs 422, 424 are coupled to seat 414 in a manner that blocks side-to-side movement of seat 414 on frame 412, shown by arrow 456 in FIG. 15.

Figure 17:
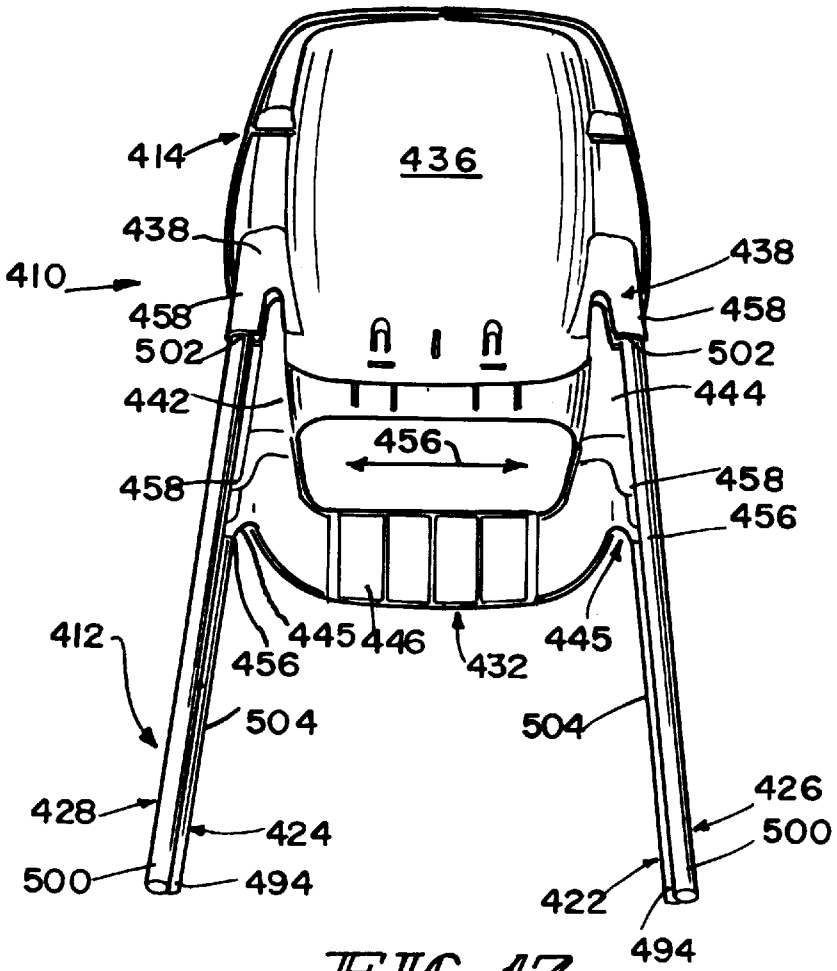
FIG. 17 is a rear view of the juvenile seat assembly of FIG. 14, showing the back legs spaced-apart from one another and extending into the rear-leg mounts of the seat.

Referring now to FIG. 17, rear-leg mounts 438 are coupled to seat 414 to lie adjacent to back portion 436 and extend away from arms 440. Rear leg mount 438 includes an a rear-leg sleeve 457 coupled to back portion 436 by spaced-apart struts 460, 462. Referring now to FIG. 18, each rear-leg sleeve 457 defines a rear passageway 464 sized to receive one of back legs 226, 228 therein. In addition, rear-leg sleeve 458 includes an inner end 466 adjacent to arm 440, an outer end 468 defining an opening 470 into rear passageway 464, and rear passageway 464 extends between inner end 466 and outer end 468.

As shown in FIGS. 14 and 15, arms 440 extend between seat bottom 430 and seat back 436. Arms 440 includes an inner surface 472, an outer surface 474 and a lip 476 extending over outer surface 474. Lip 476 is formed include slots 481 sized to receive and lock latch tray assembly 218 to seat 414.

Seat 414 further includes a front-leg mount 482 coupled to each arm 440 by screws 441. Pins, rods, rivets or other fastening mechanisms may be used to couple front-leg mount 482 to arm 440. As shown in FIG. 18, front-leg mount 482 includes a front-leg sleeve 484 and a tab 489 coupled to lip 476 and screw 441 extends through an aperture in tab 489 to couple front-leg sleeve 484 to lip 476. Each front-leg sleeve 484 defines a passageway 486 that is sized to receive one of front legs 422, 424 therein. Front-leg sleeves 484 further includes an upper end 488 and an opposite lower end 490 defining an opening 492 into passageway 486.

Figure 16:
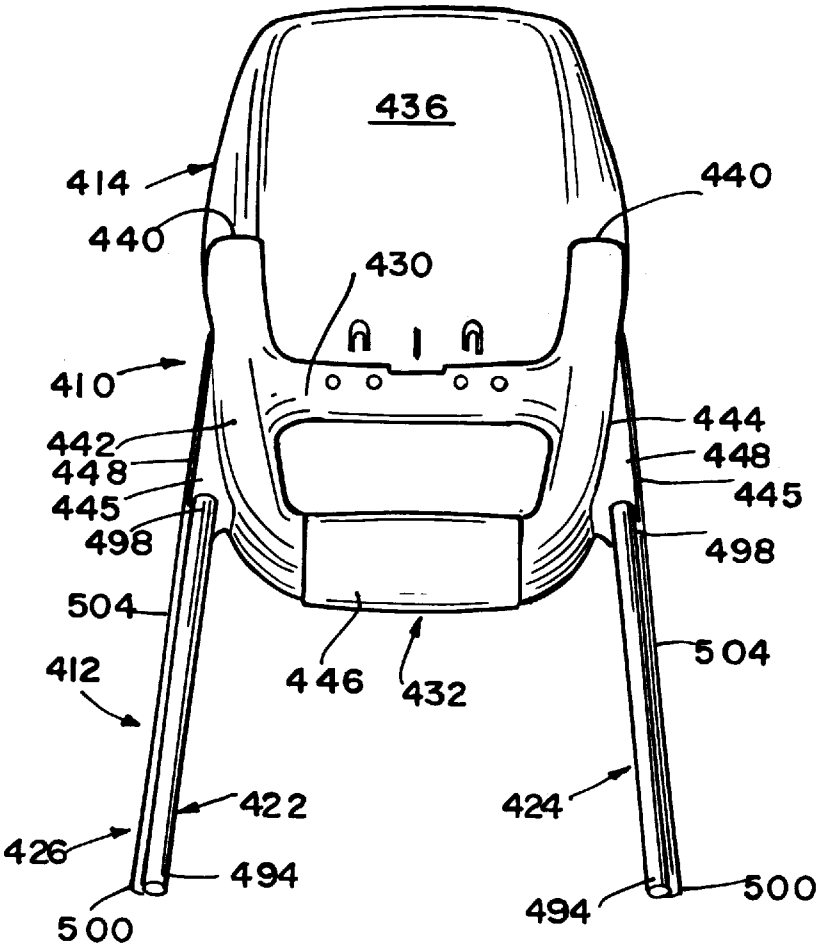
FIG. 16 is a front view the juvenile seat assembly of FIG. 14, showing the front legs extending into the front-leg cover.

Referring now to FIGS. 16 and 17, front legs 422, 424 are coupled to seat 414 and are positioned to lie in a spaced-apart generally parallel relationship relative to one another. Front legs 422, 424 each include a bottom end 494 positioned to lie adjacent to the floor and an opposite top end 496 mounted in front-leg mount 482, and a center portion 498 extending between top and bottom ends 496, 494. As shown in FIG. 18, each center portion 498 extends through a passageway 454 formed in one of the front-leg supports 445 of footrest 432 to stabilize seat 414 on front legs 422, 424.

Back legs 426, 428 are also coupled to seat 414 and lie in a spaced-apart generally parallel relationship relative to one another. Back legs 426, 428 angle away from front legs 422, 424 so that frame 412 is shaped as a generally inverted letter V. Back legs 426, 428 include a bottom end 500 positioned to lie adjacent to the floor and an opposite top end 502 mounted in rear-leg mount 438, and a center portion 504 extending between top and bottom ends 502, 500.

To assemble seat assembly 410, a user inserts back legs 426, 428 through respective openings 470 of rear-leg mount 438 until top end 502 of back legs 426, 428 extends through rear passageway 464 and lies adjacent to inner end 466 of rear-leg mount 438. To couple front legs 422, 424 to seat 414, each front leg 422, 424 is first inserted through a passageway 454 formed in one of the front-leg supports 445 of footrest 432. Top ends 496 of front legs 422, 424 are inserted though opening 492 of front-leg mount 482 until top end 496 lies adjacent to upper end 488 of front-leg mount 482. At that time, seat 414 is mounted on frame 412.

To disassemble seat assembly 10, the user must only pull front legs 422, 424 out from front-leg mounts 482 and passageways 454 of footrest 432 in direction 434 shown in FIG. 14. Rear legs 426, 428 then pulled out from rear-leg mount 438 in direction 435. Thus, seat assembly 410 can be assembled and disassembled in an easy fashion when it is necessary to transport seat assembly 410 from one location to another.

Although the invention has been described with reference to certain embodiments, variations exist within the scope and spirit of the invention as described and defined in the following claims.

What is claimed is:

1. A juvenile seat assembly comprising a seat including a seat bottom, arms extending from the seat bottom, front-leg mounts coupled to the arms, rear-leg mounts extending from the arms spaced-apart from the front-leg mounts, and a footrest having limbs coupled to the seat bottom and a support extending between the limbs, each limb including a passageway extending therethrough, a pair of front legs including a top end coupled to the front-leg mount and a center portion extending through the passageway of the limb, and a pair of back legs coupled to the rear-leg mounts.

2. The seat assembly of claim 1, wherein each of the front-leg mounts include a front-leg sleeve having an inner end coupled to the arm, an opposite outer end, and a passageway extending between the inner and outer ends.

3. The seat assembly of claim 2, wherein each front leg extends into the passageway of one of the front-leg sleeves.

4. The seat assembly of claim 1, wherein each of the rear-leg mounts includes a rear-leg sleeve having an inner end coupled to the arm, an outer end, and a passageway extending between the inner and outer ends.

5. The seat assembly of claim 1, wherein the limbs each include a front panel and side panels that define the passageway.

6. The seat assembly of claim 1, wherein the limbs of the footrest arc positioned to lie in a generally linear relationship with the front-leg mounts so that the passageway of each limb is generally aligned with the passageway of one of the front-leg mounts.

7. A juvenile seat assembly comprising a seat and a frame including front and rear legs coupled to the seat and arranged to support the seat in an elevated position above an underlying surface, the seat including a seat bottom and a footrest mounted to the seat bottom and positioned to lie below the seat bottom and formed to include a front-leg support coupled to each one of the front legs to block side-to-side movement of the seat relative to the frame.

8. The seat assembly of claim 7, wherein the footrest includes a foot support and a pair of limbs arranged to extend downwardly away from the seat bottom and coupled to the foot support and each limb includes one of the front-leg supports.

9. The seat assembly of claim 8, wherein each front-leg support is formed to include a passageway and each of the front legs is positioned to extend through one of the passageways.

10. The seat assembly of claim 9, wherein the seat further includes an arm positioned to lie above the seat bottom and each of the front legs and a front-leg mount coupled to the arm and arranged to receive an upper end of one of the front legs and each front leg further includes a lower end adapted to engage the underlying surface and a center portion located between the upper and lower ends and positioned to lie in one of the passageways formed in the front-leg supports.

11. The seat assembly of claim 8, wherein each limb includes a vertical segment interconnecting the seat bottom and the foot support and one front-leg support is coupled to the vertical segment of each limb.

12. The seat assembly of claim 11, wherein each vertical segment includes a front panel and a side panel and each front-leg support is coupled to one of the side panels.

13. The seat assembly of claim 7, wherein each front-leg support is formed to include a passageway and each of the front legs is positioned to extend through one of the passageways.

14. The seat assembly of claim 13, wherein the seat further includes an arm positioned to lie above the seat bottom and each of the front legs and a front-leg mount coupled to the arm and arranged to receive an upper end of one of the front legs and each front leg further includes a lower end adapted to engage the underlying surface and a center portion located between the upper and lower ends and positioned to lie in one of the passageways formed in the front-leg supports.

15. The seat assembly of claim 7, wherein each front leg support includes means for slidably receiving one of the front legs therein.

16. The seat assembly of claim 15, wherein each front leg includes an upper-end, a lower end, and a center portion, the upper end is coupled to the seat, and the center portion of each front leg is positioned to lie in the receiving means associated with said front leg.

17. The seat assembly of claim 16, wherein the seat further includes a pair of arms positioned to extend upwardly above the seat bottom, a front-leg mount coupled to each of the arms and arranged to receive the upper end of one of the front legs therein, and a rear-leg mount coupled to each of the arms and arranged to receive an upper end of one of the rear legs therein.

18. The seat assembly of claim 7, wherein each of the front and rear legs includes an upper end, a lower end, and a center portion between the upper and lower ends, the upper end of each of the front and rear legs is coupled to the seat, and the center portion of each of the front legs is coupled to one of the front-leg supports.

19. The seat assembly of claim 18, wherein each front-leg support is formed to include a passageway and each of the front legs is positioned to extend through one of the passageways.

20. The seat assembly of claim 18, wherein the seat further includes a pair of arms, a front-leg, mount positioned to lie on an underside of each arm and coupled to the upper end of one of the front legs, and a rear-leg mount positioned to lie on an underside of each arm and coupled to the upper end of one of the rear legs.

21. A juvenile seat assembly comprising a seat and a frame including front and rear legs coupled to the seat and arranged to support the seat in an elevated position above an underlying surface, the seat including a seat bottom, footrest mounted to the seat bottom, and means in the footrest for slidably receiving the front legs to block side-to-side movement of the seat relative to the frame.

22. The seat assembly of claim 21, wherein each front leg includes an upper end coupled to the seat, a lower end adapted to engage the underlying surface, and a center portion positioned to lie between the upper and lower ends and in the receiving means.

23. The seat assembly of claim 22, wherein the seat further includes a pair of arms, a front-leg mount coupled to each arm, and the upper end of each front leg is coupled to one of the front-leg mounts.

* * * * *